United States Patent [19]

Gates et al.

[11] 4,149,103

[45] Apr. 10, 1979

[54] INCANDESCENT LAMP HAVING EMBEDDED SUPPORT MEANS

[75] Inventors: Paul E. Gates, Danvers; Stephen F. Kimball, Georgetown, both of Mass.

[73] Assignee: GTE Sylvania Incorporated, Danvers, Mass.

[21] Appl. No.: 872,804

[22] Filed: Jan. 27, 1978

Related U.S. Application Data

[63] Continuation-in-part of Ser. No. 702,659, Jul. 7, 1976.

[51] Int. Cl.[2] ..... H01K 1/14

[52] U.S. Cl. ..... 313/315; 313/318

[58] Field of Search ..... 313/315, 318

[56] References Cited

U.S. PATENT DOCUMENTS

| | | | |
|---|---|---|---|
| 2,542,326 | 2/1951 | Greiner | 313/315 X |
| 3,617,797 | 11/1971 | Eindhoven et al. | 315/315 |

*Primary Examiner*—Saxfield Chatmon, Jr.

*Attorney, Agent, or Firm*—James Theodosopoulos

[57] ABSTRACT

In a press-sealed single-ended tubular incandescent lamp, the support means thereof is embedded in the press seal and protrudes from the edge thereof, substantially orthogonal to the axis of the lamp.

2 Claims, 3 Drawing Figures

INCANDESCENT LAMP HAVING EMBEDDED SUPPORT MEANS

THE INVENTION

This application is a continuation-in-part of Ser. No. 702,659 filed July 7, 1976.

This invention concerns press-sealed single-ended incandescent lamps. An example of such a lamp is shown in U.S. Pat. No. 3,829,729 the disclosure of which is incorporated herein by reference. This invention is particularly concerned with the situation where such a lamp is coaxially mounted in a curved reflector. In such a case support rods extend through the reflector and the lamp is supported on the rods.

Figure 1:
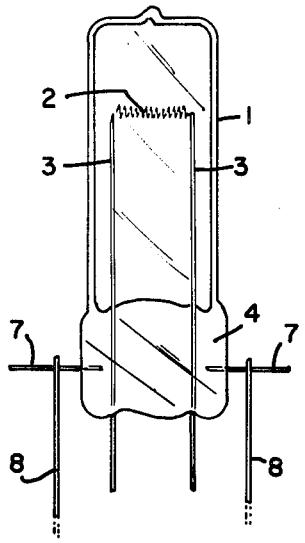
FIG. 1 shows a lamp in which a single support wire extends from each side of the press.

The same element in each figure in the drawing is identified by the same number. Each lamp comprises a tubular glass envelope 1 containing a coiled tungsten filament 2 mounted on lead-in wires 3 which are sealed in, and extend through, press seal 4. If desired, the external portion of each lead-in wire 3 could be curved back on itself, the end secured in press seal 4, to form loop 5.

When the support means for the lamp is a single support wire 7 extending from each side of press seal 4, as shown in FIG. 1, and when the lamp is horizontally mounted in a reflector after support wires 7 have been welded to support rods 8, there can be an undesirable torsional force on each support wire 7.

Figure 2:
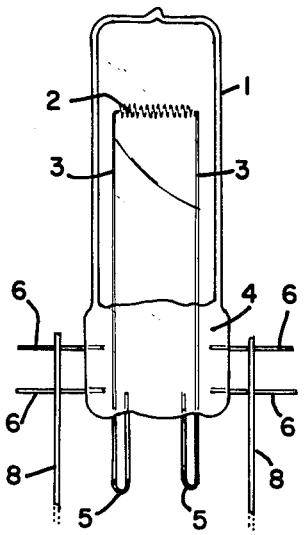
FIG. 2 shows a lamp in which two support wires extend from each side of the press.

In this invention such torsional forces are substantially eliminated by providing a support means which can be fastened to support rod 8 at more than one point running lengthwise with the lamp. In FIG. 2 each support means comprises two support wires 6 spaced apart from each other, embedded in press seal 4 and extending from the same longitudinal edge of press seal 4. If desired, the two support wires 6 can be a single U shaped wire or more than two support wires 6 can be used on each side. Support rods 8 are welded or brazed to support wires 6 as shown in FIG. 2.

Figure 3:
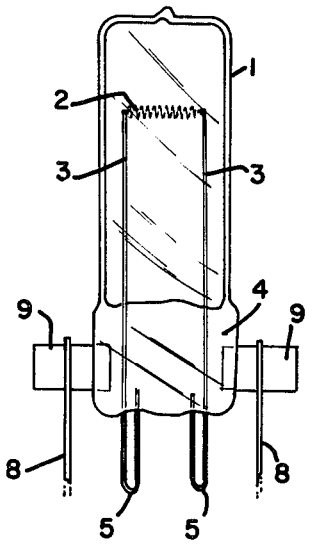
FIG. 3 shows a lamp in which a sheet metal support extends from each side of the press.

In the embodiment shown in FIG. 3, each support means comprises a flat sheet metal support 9, for example, 10 mil thick kovar alloy, embedded in press seal 4 and extending from the longitudinal edge of press seal 4. Support rod 8 is welded to sheet metal support 9 at two or more points along the length of rod 8.

We claim:

1. In a single-ended tubular incandescent lamp containing a tungsten filament and having a press seal at one end thereof, the tungsten filament being supported on lead-in wires that are sealed in the press seal, the improvement which comprises support means at each side of the press seal, said support means being independent of said lead-in wires, each support means being embedded in the press seal and extending from the longitudinal edge thereof substantially perpendicular to the envelope axis, the support means being substantially coplanar with the press seal, the support means capable of being fastened, such as by welding or brazing, to a support rod substantially coplanar with the support means and at a plurality of points thereof that run lengthwise with the lamp.

2. In a single-ended tubular incandescent lamp containing a tungsten filament and having a press seal at one end thereof, the tungsten filament being supported on lead-in wires that are sealed in the press seal, the improvement which comprises support means at each side of the press seal, said support means being independent of said lead-in wires, each support means being so disposed that a support rod generally extending longitudinally with respect to the lamp can be fastened to said support means at at least two points that are apart from each other in a direction that is longitudinal with respect to the lamp.

* * * * *